United States Patent [19]

Hornüng et al.

[11] Patent Number: 4,617,069

[45] Date of Patent: Oct. 14, 1986

[54] METHOD FOR IMPROVING THE IMMUNITY TO TEMPERATURE CHANGES OF CAST IRON CONTAINING LAMELLAR GRAPHITE

[75] Inventors: Klaüs Hornüng, Stein a. Rhein; Anton Alt, Schaffhausen, both of Switzerland; Günter Schulte, Velbert, Fed. Rep. of Germany; Fritz Mahnig, Schaffhausen, Switzerland

[73] Assignee: Georg Fischer Aktiengesellschaft, Schaffhausen, Switzerland

[21] Appl. No.: 589,127

[22] Filed: Mar. 13, 1984

[30] Foreign Application Priority Data

Mar. 14, 1983 [CH] Switzerland ..... 1373/83

[51] Int. Cl.[4] ..... C22C 37/00

[52] U.S. Cl. ..... 148/138; 148/321

[58] Field of Search ..... 148/3, 138, 35; 75/129, 75/130 C, 130 A, 130 AB, 130 B, 130 BB, 130 C, 53, 123 CB

[56] References Cited

U.S. PATENT DOCUMENTS

| | | | |
|---|---|---|---|
| 3,282,683 | 6/1962 | Moore | 75/130 R |
| 3,419,439 | 12/1968 | Burgess | 148/138 |

FOREIGN PATENT DOCUMENTS

| | | | |
|---|---|---|---|
| 1804690 | 6/1970 | Fed. Rep. of Germany | 75/130 R |
| 2045414 | 5/1972 | Fed. Rep. of Germany | 148/35 |
| 2428821 | 12/1975 | Fed. Rep. of Germany | 75/123 CB |
| 2808325 | 9/1978 | Fed. Rep. of Germany | 148/3 |
| 44-12264 | 1/1969 | Japan . | |
| 47-1872 | 1/1972 | Japan | 75/130 R |
| 487155 | 1/1976 | U.S.S.R. | 75/130 R |
| 0709691 | 1/1980 | U.S.S.R. | 75/130 R |

*Primary Examiner*—L. Dewayne Rutledge
*Assistant Examiner*—Deborah Yee
*Attorney, Agent, or Firm*—Toren, McGeady, Stanger, Goldberg & Kiel

[57] ABSTRACT

A method is disclosed for improving the immunity to temperature changes of cast iron containing lamellar graphite. The structure of the cast iron melt is suitably adjusted by means of carbide forming agents, to wit chromium and/or molybdenum and an annealing treatment in such a manner that the gray cast iron withstands increased thermal shock and dynamic stresses.

5 Claims, 2 Drawing Figures

Figure 1:
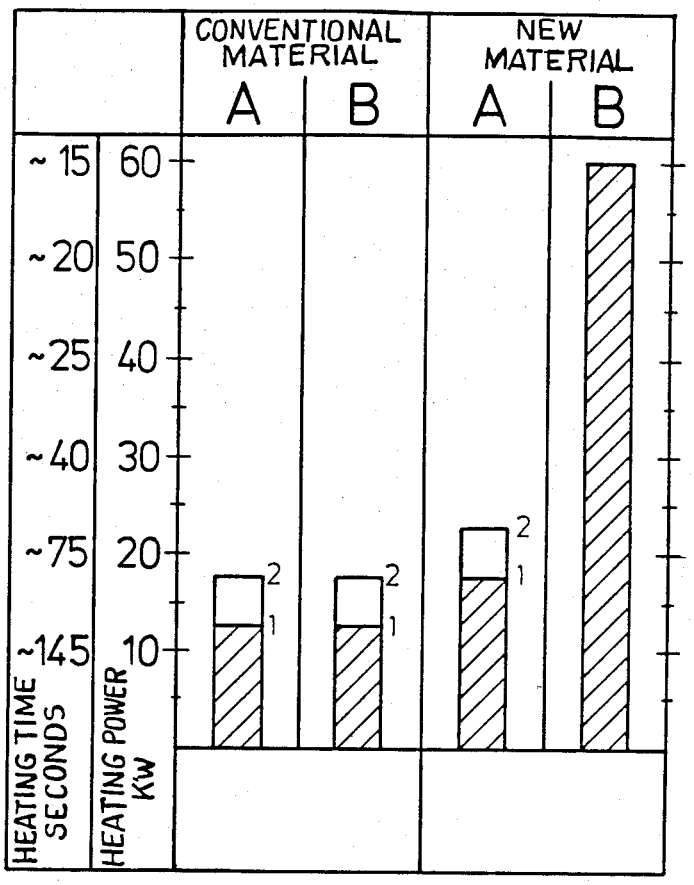

METHOD FOR IMPROVING THE IMMUNITY TO TEMPERATURE CHANGES OF CAST IRON CONTAINING LAMELLAR GRAPHITE

FIELD OF THE INVENTION

The invention generally relates to cast iron and is particularly directed to a method for improving the immunity to temperature changes of cast iron containing lamellar graphite, as well as to cast iron and objects cast from the improved cast iron.

BACKGROUND OF THE INVENTION

Cast iron containing lamellar graphite (gray cast iron) is used, for example, in motor vehicle construction. Such cast iron is thus used as a material for casting clutch disks, flywheels, brake drums and disks, exhaust manifolds, and the like.

Because of the high thermal stresses to which such motor car parts are subjected, they have to be resistant to temperature changes to the same extent as they have to be resistant to wear and breakage.

For all intents and purposes, cast iron which is resistant or immune to thermal shocks or considerable thermal changes does not exist per se. The cast iron material which best meets the particular requirements must rather be determined by optimizing the strength characteristics, the composition, and grain structure in dependence upon the particular requirements.

The phenomena which takes place in the cast iron as the result of the stresses due to temperature changes and due to the temperature change itself are highly complex. On account of rapidly changing temperature differences, stresses and grain structure changes occur in the cast object. The latter, in turn, have a tendency to change the characteristics of the material and, since they are mostly associated with volume changes, additional stresses may be caused which then lead to cracks and fissures in the cast objects.

OBJECT OF THE INVENTION

The primary object of this invention is a method for overcoming the above-mentioned disadvantages and drawbacks, which method results in a cast iron product which exhibits not only excellent wear characteristics, but also has considerable resistance or immunity against temperature changes.

Another object of the invention is to provide gray cast iron exhibiting immunity to temperature changes.

Still, a further object of the invention is to provide motor car parts made of gray cast iron which exhibit improved resistance or immunity to temperature changes.

DESCRIPTION OF THE INVENTION

The above objects are attained by manufacturing lamellar graphite containing cast iron by admixing a cast iron melt containing lamellar graphite with at least one carbide forming agent, permitting the melt to solidify and subjecting the solidified mixture to an annealing treatment which substantially maintains the initial structure and by adjusting the saturation degree at $<1$.

The carbide forming agent is Mo and/or Cr. It has been ascertained that the optimum results are obtained if 0.3 to 0.5% by weight of Mo or Cr are added as the carbide forming agent.

The annealing is carried out at a temperature of between about 650° C. to 760° C., preferably 720° to 760° C., for a period of about $\leqq 3$ hours.

The saturation degree is adjusted in accordance with the formula $S=(\%C/4.3)-\frac{1}{3}(\%Si+\%P)$.

The resulting gray cast iron has a strength of at least $280N/_{mm2}$ at a hardness of $\leqq 240$ HB.

The invention will now be described by several examples, it being noted that these examples are given by way of illustration and not by way of limitation.

On an engine testing station, critical stress conditions are simulated in flywheels. An engine, (for example, 1.6 L, 70 kW) is connected with the drive shaft. The engine is brought to an rpm of 5,000, the drive shaft is blocked, the clutch drags for up to 1.5 minutes on the disk flywheel, the lining wears and temperatures of up to 800° C. The disk must be able to withstand this test five times.

A disk flywheel of the following new material composition was tested: 3.2 wt% C, 2.2 wt% Si, 0.57 wt% Mn, 0.056 wt% P, 0.1 wt% S, 0.16 wt% Cu, 0.45 wt% Cr, 0.31 wt% Mo, with the remainder Fe with a grain matrix structure of about 100% pearlite and a saturation degree of 0.91.

As the Table of FIG. 1 shows, disk A and disk B of the same composition were tested. The difference between the two disks was that disk B was heat treated by annealing at a temperature of 720° C. for two and one half hours. The Table shows the performance/time during which the disk was crack-free (1) and the performance/time at which the first cracks appeared (2).

The formation of cracks occurs during rapid heating. The cause for this lies in the fact that the compression strength is much greater than the tensile strength. During the heating, high compressive stresses are developed in the hot zone while high tensile stresses occur by contrast in the cold zone. If the heating-up process takes place rapidly, the compressive stresses in the hot zone can no longer be reduced by creep. The high tensile stresses or strains in the cold region are no longer reduced by elastic or plastic deformations and a break occurs when the tensile strength is exceeded.

On the basis of these considerations, the proposed material should have the following properties:

(a) ratio: hot compression strength/tensile strength→1

(b) high thermal conductivity (c) ductility.

The investigations have shown that the greatest importance must be assigned to property c. If hardness is used as a reference value for ductility, components, which are exposed to thermal shocks, should have a high tensile strength and a low hardness.

The Table of FIG. 1 shows that the values for the new material are at least 5 times as high as those for conventional, mass-produced disks containing 3.2% C, 2.2% Si, 0.157% Mn, 0.056% P, 0.1 S and up to 0.16 Cu and therefore offers outstanding resistance to thermal shocks.

High thermal conductivity is desirable in order to be better able to absorb occuring thermal shock stresses. For this purpose, the amount and arrangement of the graphite appears to be of importance.

However, if the heat treatment is carried out properly, the graphite formation is of subordinate importance.

Figure 2:
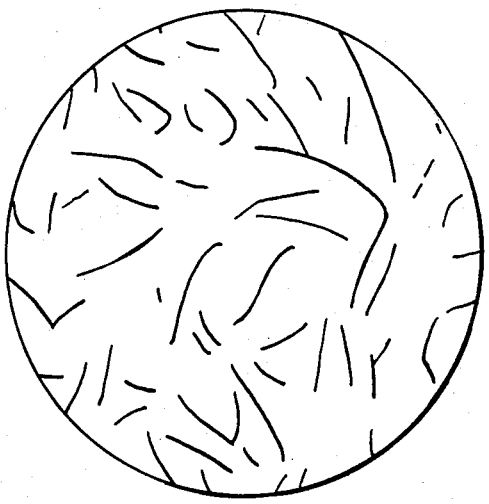

It has been ascertained that A-graphite ensures the best conditions for longer durability. A-graphite is a graphite present in iron and carbon alloys in the configuration schematically illustrated in FIG. 2.

The decrease in strength, which is to be expected because of the higher carbon or graphite content, is partly compensated for by increased chromium and molybdenum contents. The tensile strength is approximately $280N/_{mm2}$, while the hardness is less than 220 HB.

An annealing treatment of the disk for about 3 hours at 720°–760° C. improves thermal shock resistance. This is explained by a decrease in internal stresses, as a result of which the decrease in strength of the basic composition is compensated for in conjunction with the chromium and/or molybdenum contents.

Chromium and molybdenum favor carbide formation. Chromium and molybdenum carbide largely survive the annealing treatment and displace grain structure break-up, that is, the ferritization, to the higher end of the temperature scale.

As apparent, the heat treatment has increased the thermal shock resistance considerably.

If the grain structure is so adjusted that the degree of saturation is less than 1, the ferritizing tendency during the heat treatment is retarded and the tensile strength does not decrease more than is desirable.

The conditions described permit gray cast iron castings with lamellar graphite to be produced reproducibly and with very good resistance to thermal shocks.

While a specific embodiment of the invention has been shown and described in detail to illustrate the application of the inventive principles, it will be understood that the invention may be embodied otherwise without departing from such principles.

What is claimed is:

1. A method of manufacturing a gray cast iron for a motor car part having improved immunity to temperature changes, consisting essentially of comprising annealing for up to three hours at 650° C. to 720° C. a cast iron which contains lamellar graphite, a grain structure of about 100% pearlite, and about 3.2% C, about 2.2% Si, about 0.056% P and about 0.3 to 0.5% by weight of at least one member of the group consisting of Cr and Mo and the remainder being Fe and whose saturation degree S is adjusted at $<1$ in accordance with formula $S=(\%C/4.3)-\frac{1}{3}(\%Si+\%P)$.

2. The method of claim 1, wherein the temperature is between about 720°–760° C.

3. Gray cast iron containing lamellar graphite obtained by the method of claim 1 and having a tensile strength of at least $280N/_{mm2}$ at a hardness of $\leqq 240$ HB.

4. A motor car part made of gray cast iron manufactured according to the method of claim 1 and having the characteristics of claim 3.

5. A cast motor car part made of gray cast iron manufactured according to the method of claim 1 and having the characteristics of claim 3.

* * * * *